US005987285A

United States Patent [19]

Kusayanagi

[11] Patent Number: 5,987,285

[45] Date of Patent: Nov. 16, 1999

[54] BELT TYPE PHOTOSENSITIVE MEMBER CLEANING APPARATUS FOR WET TYPE IMAGE FORMING APPARATUS

[75] Inventor: Toshiya Kusayanagi, Kashiwazaki, Japan

[73] Assignee: NEC Corporation, Japan

[21] Appl. No.: 09/273,985

[22] Filed: Mar. 22, 1999

[30] Foreign Application Priority Data

Mar. 23, 1998 [JP] Japan ..... 10-074587

[51] Int. Cl.[6] ..... G03G 15/10

[52] U.S. Cl. ..... 399/249; 399/348

[58] Field of Search ..... 399/249, 348

[56] References Cited

U.S. PATENT DOCUMENTS 3,957,510 5/1976 Hermanson ..... 430/33
5,713,068 1/1998 Teschendorf et al. ..... 399/249

FOREIGN PATENT DOCUMENTS 4-333081 11/1992 Japan .
5-27653 2/1993 Japan .
6-317989 11/1994 Japan .

*Primary Examiner*—William Royer
*Assistant Examiner*—Greg Moldafsky
*Attorney, Agent, or Firm*—Ostrolenk,Faber,Gerb & Soffen, LLP

[57] ABSTRACT

The invention provides a belt type photosensitive member cleaning apparatus for a wet type image forming apparatus which can effectively remove liquid developer pressed out by a pair of pressing out rollers for removing remaining liquid developer from a belt like photosensitive member after developed to prevent such liquid developer from flowing out and soiling to a window for a sensor or the photosensitive member. Each of the pressing out rollers provided in a stage next to a first pressing out roller has grooves formed at the opposite end portions thereof such that liquid developer which tends to be pressed out from the opposite ends of each of the second pressing out rollers is collected in the grooves. A pair of wiper blades having a length greater than the longitudinal ranges of the pair of pressing out rollers are disposed for being pressed against the outer peripheries of the pair of pressing out rollers including inner faces of the annular grooves at the opposite ends on the outer peripheries of the pair of pressing out rollers.

3 Claims, 6 Drawing Sheets

BELT TYPE PHOTOSENSITIVE MEMBER CLEANING APPARATUS FOR WET TYPE IMAGE FORMING APPARATUS

BACKGROUND OF THE INVENTION

1. Field of the Invention

The present invention relates to a wet type image forming apparatus which is employed in an electrophotographic printing apparatus or a like apparatus and converts an electrostatic latent image formed on a belt type photosensitive member into a visible image, and more particularly to a construction of a cleaning apparatus for a belt type photosensitive member of an image forming apparatus of the type mentioned.

2. Description of the Related Art

A development station of a wet type image forming apparatus which employs a belt type photosensitive member generally has such a construction as shown in FIG. 8. Referring to FIG. 8, a bell type photosensitive member (hereinafter referred to simply as photosensitive member) B on which an electrostatic latent image is formed is fed in a direction indicated by an arrow mark a to a position between a development roller 1 and an upper roller (not shown) located above the development roller 1. Then, liquid developer T1 is supplied from a liquid developer supply port (not shown) to a very small gap between the development roller 1 and the photosensitive member B to develop the photosensitive member B when the photosensitive member B passes the gap.

Then, the photosensitive member B passes between a first pressing out roller 4 and an upper roller (not shown) located above the first pressing out roller 4, whereupon the liquid developer is pressed out from the photosensitive member B by a contacting pressure between the two rollers. The photosensitive member B is further pressed by a pair of second pressing out rollers 5, which are provided in the following stage and rotate in a direction opposite to the direction of the arrow mark, so that the remaining liquid developer is removed from the photosensitive member B. By the processing, the image on the photosensitive member B is converted into a film-like image. Then, the image is dried and transferred to paper.

The wet type image forming apparatus described above, however, has a problem in that, when the second pressing out rollers 5 remove remaining liquid developer from the photosensitive member B, they press out part of liquid developer T2 as seen in FIG. 8, and the thus pressed out liquid developer T2 sometimes soils a window of a sensor (not shown) provided in the proximity of an end portion of the photosensitive member B or soils an end portion of transfer paper.

SUMMARY OF THE INVENTION

It is an object of the present invention to provide a belt type photosensitive member cleaning apparatus for a wet type image forming apparatus which can effectively remove liquid developer pressed out by a pair of second pressing out rollers.

In order to attain the object described above, according to the present invention, there is provided a belt type photosensitive member cleaning apparatus for a wet type image forming apparatus, comprising a first pressing out roller for being pressed against a belt type photosensitive member fed thereto to remove remaining liquid developer on the belt type photosensitive member, a pair of second pressing out rollers for being pressed against the belt type photosensitive member on the downstream of and adjacent the opposite ends of the first pressing out roller to remove liquid developer having passed the opposite ends of the first pressing out rollers and remaining on the belt-shaped photosensitive member, the second pressing out rollers being arranged such that the outer ends thereof are positioned outside the longitudinal range of the first pressing out roller, each of the pair of second pressing out rollers having an annular groove formed like a ring at each of the opposite end portions on an outer periphery thereof, and a pair of wiper blades having a length greater than the longitudinal ranges of the second pressing out rollers and disposed for being pressed against the outer peripheries of the second pressing out rollers including inner faces of the annular grooves at the opposite ends on the outer peripheries of the second pressing out rollers.

With the belt type photosensitive member cleaning apparatus for a wet type image forming apparatus, since each of the second pressing out rollers has an annular groove formed like a ring at each of the opposite end portions on an outer periphery thereof, liquid developer which tends to be pressed out from the second pressing out rollers can be collected in the grooves. Consequently, such a trouble that the liquid developer flows out and soils a window for a sensor or the belt type photosensitive member can be prevented.

Each of the second pressing out rollers may have a plurality of annular grooves formed at each of the opposite end portions thereof. This is effective particularly where a comparatively large mount of liquid developer remains on the belt type photosensitive member.

Preferably, each of the wiper blades has a concave-convex portion which is pressed against a corresponding one of the second pressing out rollers over the overall longitudinal range of the second pressing out roller including the annular grooves formed thereon. The wiper blades here can remove liquid developer completely from the second pressing out rollers. Further, the most effective shape of the grooves of the second pressing out rollers can be selected depending upon conditions of the wet type image forming apparatus.

The above and other objects, features and advantages of the present invention will become apparent from the following description and the appended claims, taken in conjunction with the accompanying drawings in which like parts or elements are denoted by like reference symbols.

DESCRIPTION OF THE PREFERRED EMBODIMENT

Figure 1:
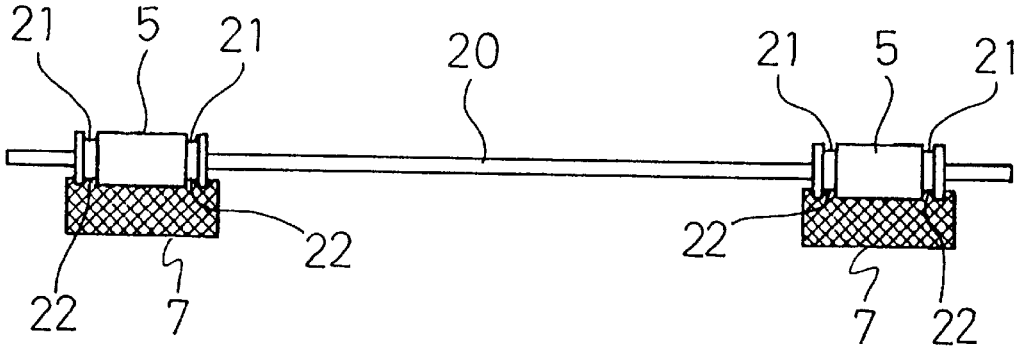
FIG. 1 is a schematic front elevational view showing a construction of a pair of second pressing out rollers of a belt type photosensitive member cleaning apparatus to which the present invention is applied.

Referring first to FIGS. 1 to 6, there is shown a wet type image forming apparatus in which a belt type photosensitive member cleaning apparatus according to the present invention is incorporated. The wet type image forming apparatus is generally denoted at 100 and includes a support base 11 supported for upward and downward movement along a pair of grooves 12 formed on a housing 10, and a cam 110 supported for rotation in the direction indicated by an arrow mark e on the housing 10. The cam 110 is held in contact with a shaft 13 provided on the support base 11 and is rotatable to move the support base 11 upwardly or downwardly.

Figure 3:
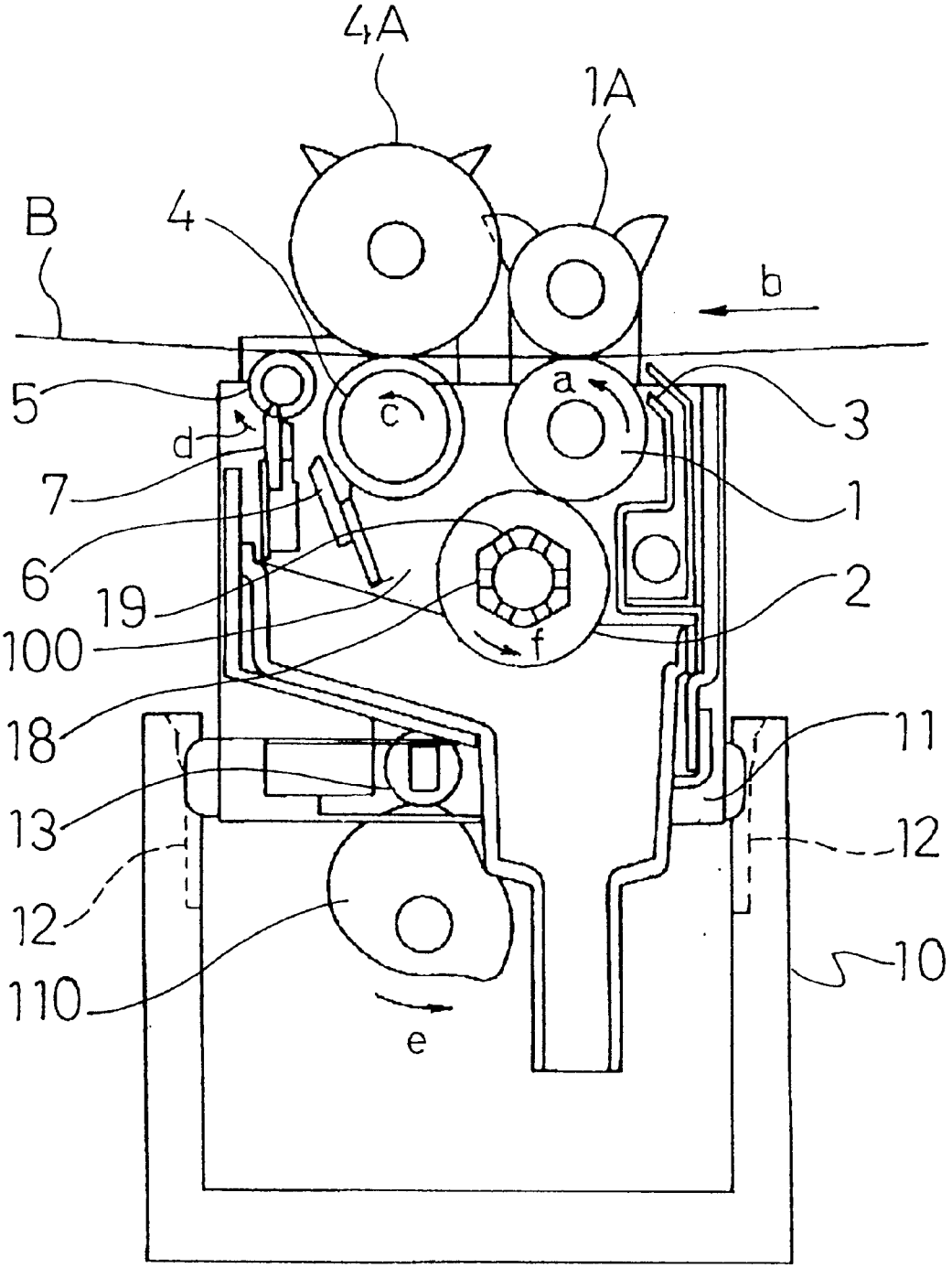
FIG. 3 is a schematic sectional view of the wet type image forming apparatus during printing operation.
Figure 4:
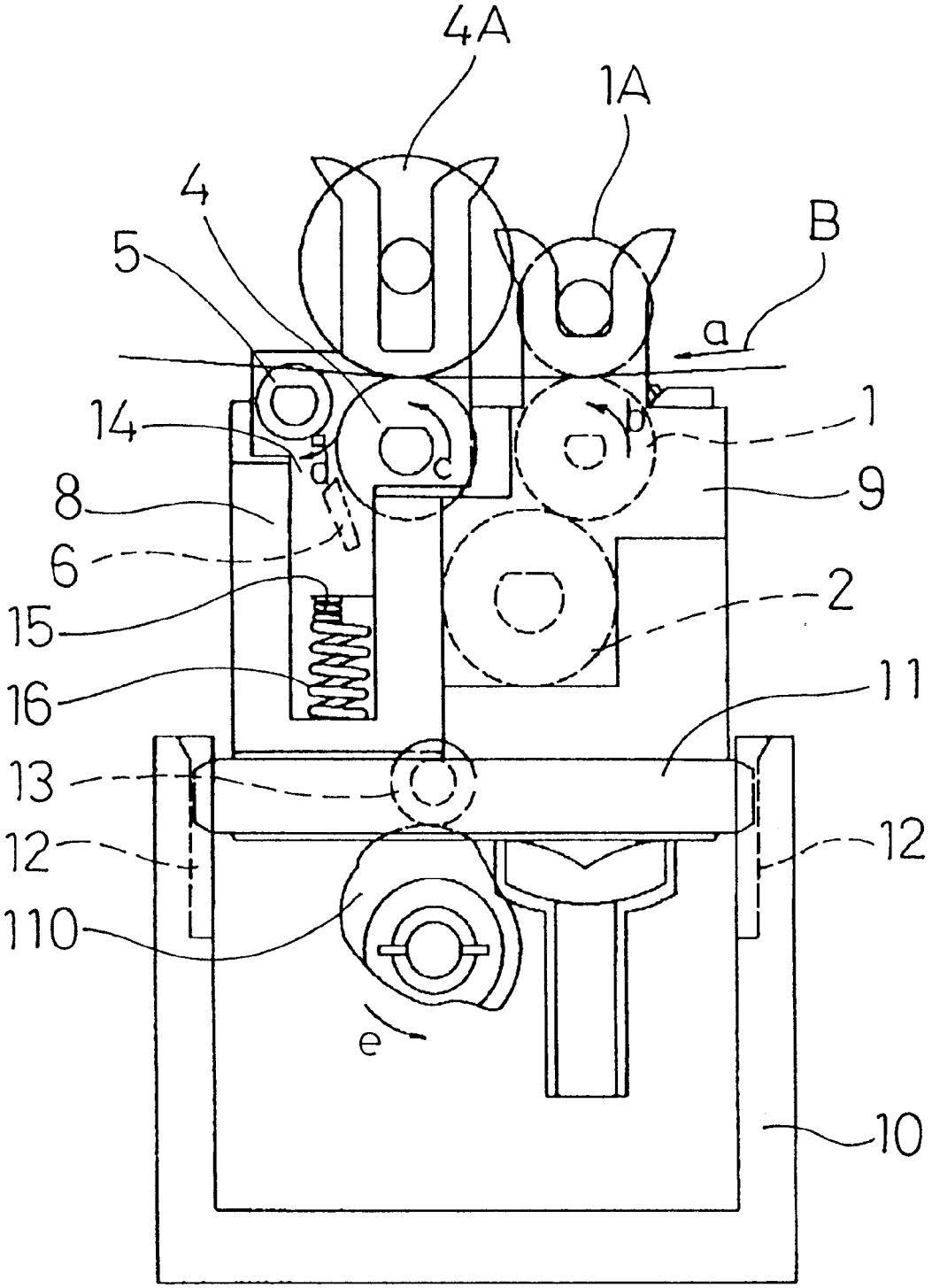
FIG. 4 is a schematic side elevational view of the wet type image forming apparatus during printing operation.
Figure 5:
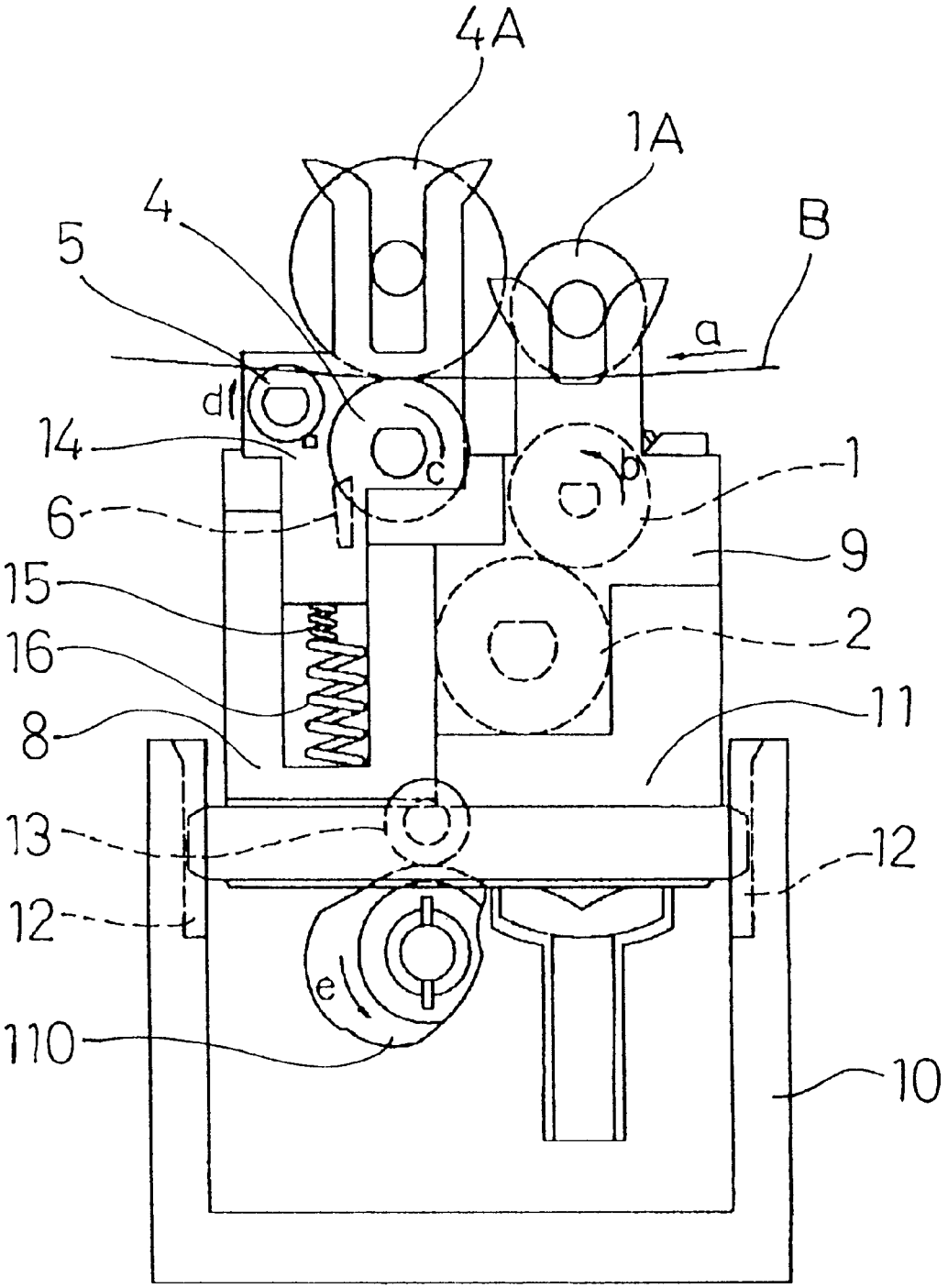
FIG. 5 is a similar view but showing the wet type image forming apparatus in a state immediately prior to stopping.
Figure 6:
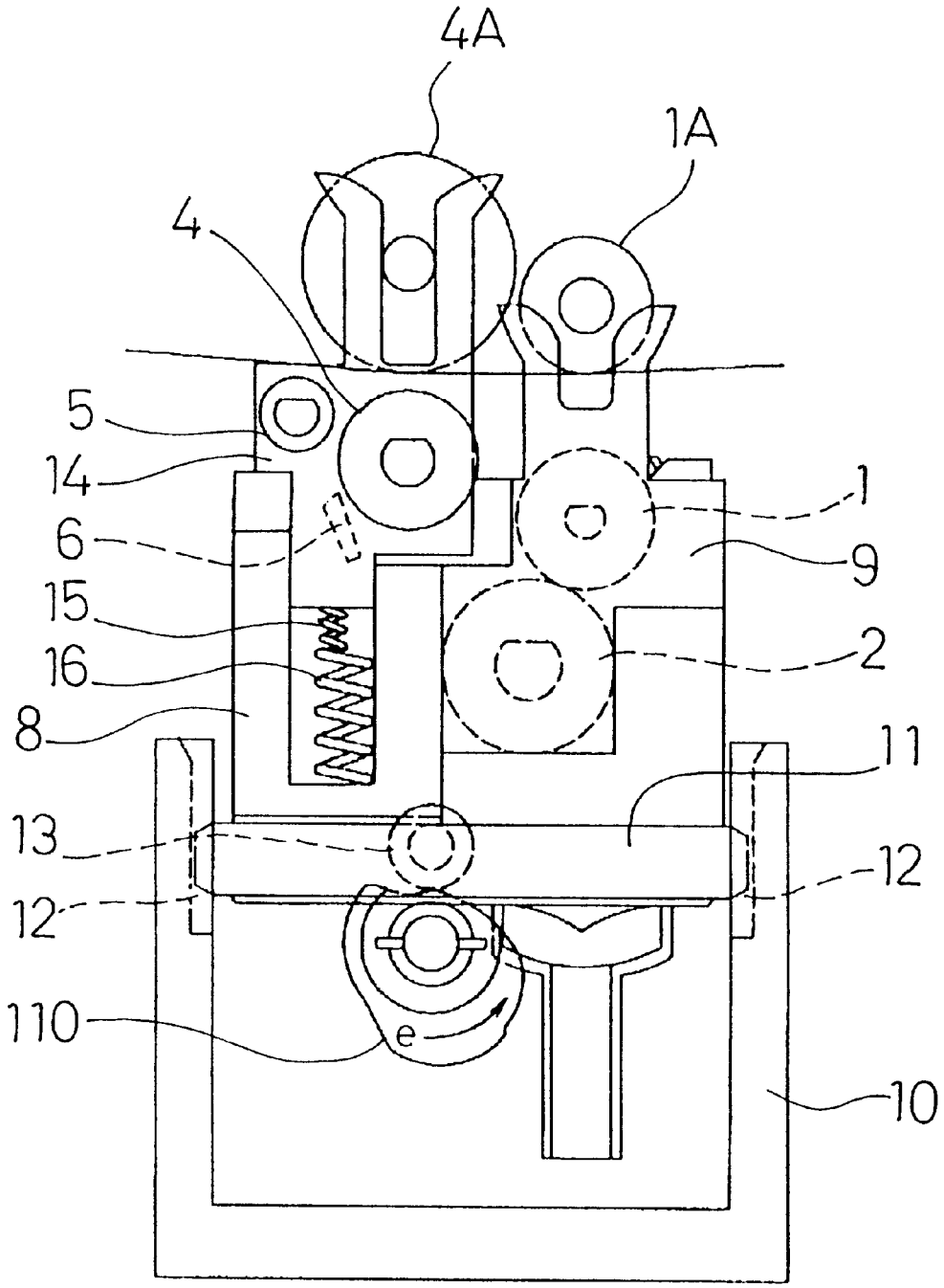
FIG. 6 is a similar view but showing the wet type image forming apparatus in a stopping state.

A development support 9 and a pressing out roller support 8 are provided integrally on the support base 11. A roller shaft support table 14 is supported on the pressing out roller support 8 with a pair of compression springs 15 and 16 interposed therebetween. The compression spring 15 has a high spring constant while the compression spring 16 has a low spring constant. During printing of the wet type image forming apparatus 100, the support base 11 is positioned at its highest position against the biasing force of the compression springs 15 and 16 by the cam 110 as seen in FIGS. 3 and 4, but immediately before the printing operation of the cam 110 stops, the support base 11 is allowed to be lowered to an intermediate position as seen in FIG. 5 under the biasing force of the compression springs 15 and 16 by the cam 110. Then, when the printing operation stops, the support base 11 is allowed to be lowered to its lowest position as seen in FIG. 6 under the biasing force of the compression springs 15 and 16 by the housing 10.

A development roller 1 and a cleaning roller 2 are mounted for rotation in the directions indicated by arrow marks b and f in FIG. 3, respectively, on the development support 9, and a pair of upper rollers 1A and 4A are located at upper portions of the wet type image forming apparatus 100. Further, a first pressing out roller 4 and a pair of second pressing out rollers 5 are mounted for rotation in the directions indicated by arrow marks c and d in FIG. 3, respectively, on the roller shaft support table 14. Also a first wiper blade 6 and a pair of second wiper blades 7 both made of urethane rubber are provided on the roller shaft support table 14.

Development and cleaning of a belt type photosensitive member B is performed while it successively passes between the development roller 1 and the upper roller 1A, between the first pressing out roller 4 and the upper roller 4A and on the second pressing out rollers 5 in the direction of an arrow mark a.

The development roller 1 is formed from a cylindrical member of a metal and is positioned so that, upon development, a very small gap of, for example, approximately 150 $\mu$m is defined between the development roller 1 and the belt type photosensitive member B. Thus, when the belt type photosensitive member B passes the gap, an electrostatic latent image on the belt type photosensitive member B is developed with liquid developer supplied from a liquid developer supply port 3 to the gap. Immediately before the development operation stops, the support base 11 is moved down to the intermediate position and thereupon the development roller 1 is spaced away from the belt type photosensitive member B as seen in FIG. 5.

The cleaning roller 2 is formed from a cylindrical member having a length substantially equal to that of the development roller 1 and has a roller portion formed from a sponge-like member (trade name: Scotch Bright by 3M) and a shaft portion 18 formed from a hollow metal member. As seen from FIG. 3, a portion of the shaft portion 18 of the cleaning roller 2 on which the sponge-like member is provided has a hexagonal cross section and has a Large number of holes 19 perforated therein.

When liquid developer is supplied into the hollow shaft portion 18 of the cleaning roller 2, it goes out through the holes 19 and is absorbed by the sponge-like member of the cleaning roller 2. Then, the cleaning roller 2 is rotated in the direction indicated by an arrow mark fin FIG. 3 while being held in contact with an outer periphery of the development roller 1 to remove liquid developer remaining on the development roller 1 with the liquid developer oozing out from the sponge-like member.

The belt type photosensitive member B for which the development operation has been completed passes between the first pressing out roller 4 and the upper roller 4A above the first pressing out roller 4, and thereupon, the liquid developer is pressed out by the pressing force between the first pressing out roller 4 and the upper roller 4A. Then, the belt type photosensitive member B is brought into contact with the second pressing out rollers 5 in the next stage, and thereupon, the liquid developer is pressed out completely by the pressing force of the second pressing out rollers 5. Thereafter, the belt type photosensitive member B is dried by a drying station not shown, and the developed image of the belt type photosensitive member B is transferred to transfer paper not shown. Meanwhile, liquid developer remaining on the first pressing out roller 4 and the second pressing out rollers 5 is removed by the first wiper blade 6 and the second wiper blades 7, respectively, and fed back into the wet type image forming apparatus 100.

Further, when the wet type image forming apparatus 100 stops its operation, the support base 11 is lowered to its lowest position as seen in FIG. 6. Consequently, also the roller shaft support table 14 is lowered, and the first pressing out roller 4 and the second pressing out rollers 5 are both spaced away from the belt type photosensitive member B.

Operation of the wet type image forming apparatus 100 having the construction described above is described. Liquid developer supplied from the liquid developer supply port 3 is fed into the gap between the belt type photosensitive member B and the development roller 1 as the development roller 1 is rotated in the direction indicated by the arrow mark b in FIG. 4, and an electrostatic latent image on the belt type photosensitive member B which comes to the gap is developed. In this instance, some liquid developer which has not been used for the development operation remains on the outer periphery of the development roller 1. Thus, the remaining liquid developer is removed by the cleaning roller 2 from which liquid developer oozes out so that it may not have a bad influence on a next development operation.

Since surplus liquid developer sticks to the developed image on the belt type photosensitive member B immediately after the development operation, it is squeezed or pressed out by the first pressing out roller 4 which is pressed against the belt type photosensitive member B under the force of 12 [kgf]. Consequently, the image now becomes a film-like image. Since the film-like image must be dried subsequently, it is fed to the drying unit not shown, in which it is dried. Then, the dried image is transferred to paper by the transfer unit. In this instance, the second pressing out rollers 5 are pressed under the force of 0.5 [kgf] against the belt type photosensitive member B and driven to rotate in the direction indicated by the arrow mark d in FIG. 4, thereby removing that liquid developer which stuck to portions of the belt type photosensitive member B outside the opposite longitudinal ends of the first pressing out roller 4 by the squeezing or pressing out operation of the first pressing out roller 4. The thus removed liquid developer is returned into the housing 10 by the second wiper blades 7 which are individually held in contact with the second pressing out rollers 5.

Thereafter, the cam 110 is rotated in the direction indicated by the arrow mark e in FIG. 5 again. Thereupon, the support base 11 is lowered from the intermediate position (for cleaning) to the lowest position and rotation of the first pressing out roller 4 and the second pressing out rollers 5 is stopped. Further, the first wiper blade 6 is spaced away from the outer periphery of the first pressing out roller 4. Finally, the belt type photosensitive member B stops.

Figure 2:
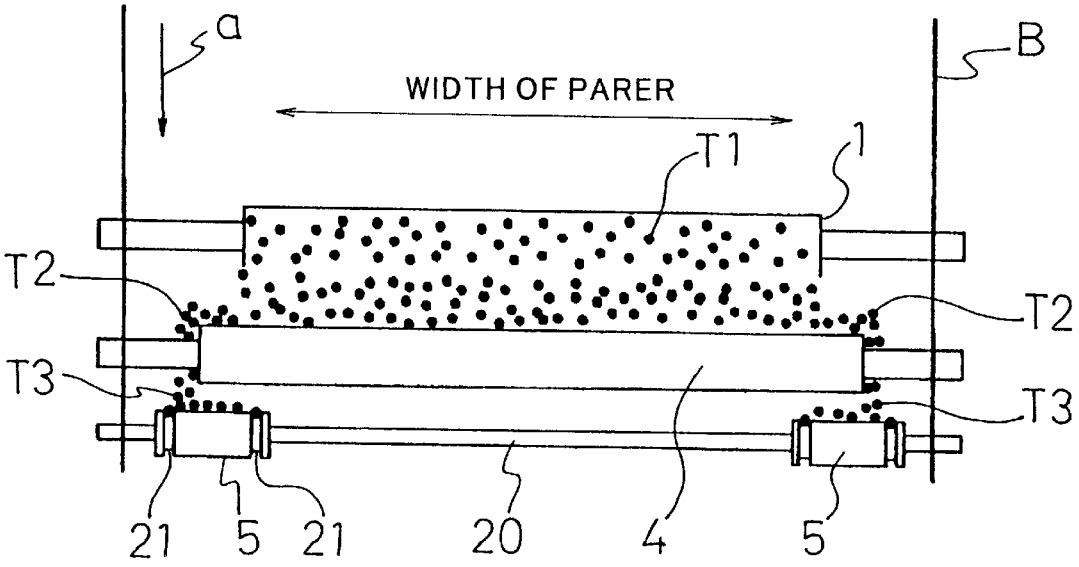
FIG. 2 is a schematic plan view showing a construction of a development station of a wet type image forming apparatus in which the belt type photosensitive member cleaning apparatus is incorporated.

FIG. 1 shows a first form of the second pressing out rollers 5 and the second wiper blades 7, and FIG. 2 schematically shows a general construction of the development station. Referring to FIGS. 1 and 2, a pair of second pressing out rollers 5 are mounted on the opposite ends of a common shaft 20 such that the outer ends thereof are positioned outside the longitudinal range of the first pressing out roller 4 in the preceding stage. Each of the second pressing out rollers 5 has a pair of annular grooves 21 of a channel-shaped cross section formed like lings along the circumference thereof in the proximity of the opposite ends.

Each of the second wiper blades 7 for individually contacting with the second pressing out rollers 5 is made of a material having suitable elasticity and absorptivity such as urethane rubber, and has a pair of concave-convex portions 22 formed thereon for contacting with the entire circumferential face of the corresponding second pressing out roller 5 including the inside of the grooves 21 when the corresponding second pressing out roller 5 on which the grooves 21 are formed rotates.

With the wet type image forming apparatus 100 having the construction described above, when remaining liquid developer T2 from the belt type photosensitive member B pressed out to the outer sides of the longitudinal range of the first pressing out roller 4 by operation of the development roller 1 arrives at the second pressing out rollers 5, it sticks to the outer peripheries of the second pressing out rollers 5 and part of it is removed from the belt type photosensitive member B. However, the remaining liquid developer T3 tends to be pressed out from the longitudinal ranges of the second pressing out rollers 5. In this instance, the liquid developer T3 tending to be pressed out collects into the grooves 21 formed on the second pressing out rollers 5. Consequently, the liquid developer T3 is prevented from flowing out to the outsides of the longitudinal ranges of the second pressing out rollers 5.

The liquid developer is thus removed completely from the belt type photosensitive member B, the liquid developer including the liquid developer collecting in the grooves 21 of the second pressing out rollers 5 is removed from the grooves 21 by the second wiper blades 7.

Figure 7:
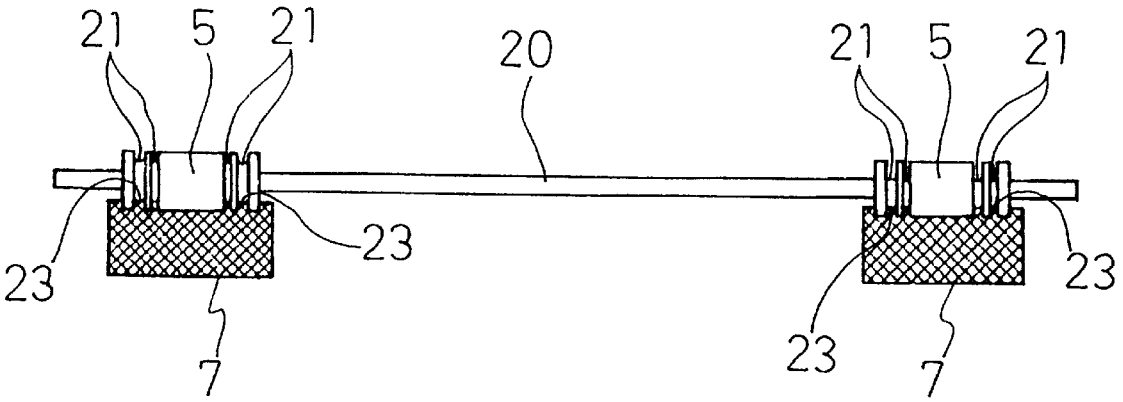
FIG. 7 is a front elevational view showing a construction of another pair of second pressing out rollers of a belt type photosensitive member cleaning apparatus to which the present invention is applied.
Figure 8:
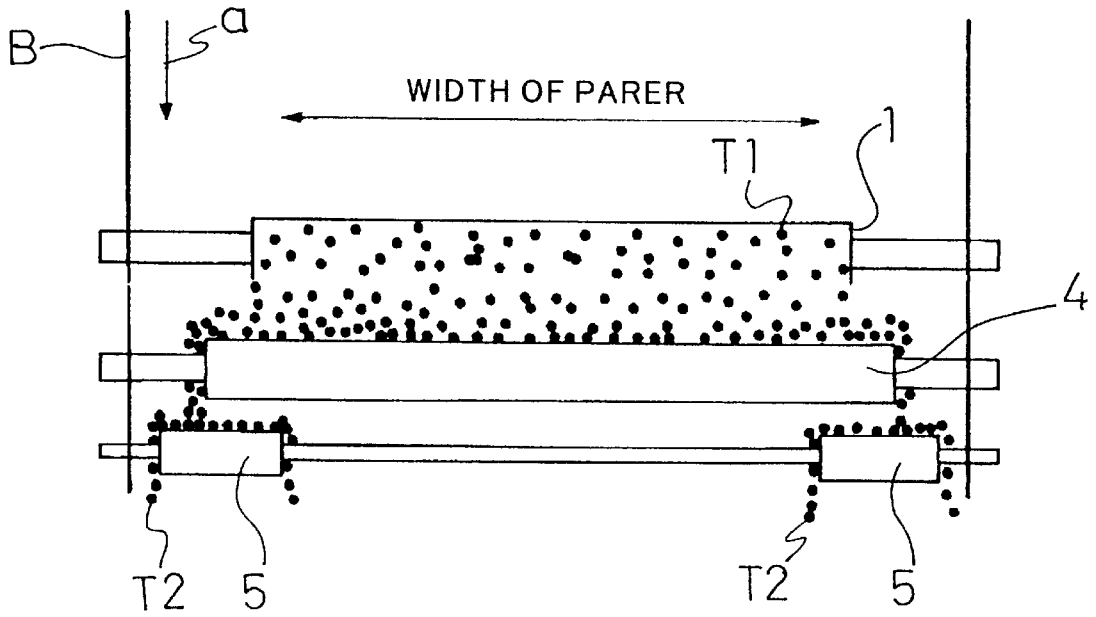
FIG. 8 is a schematic plan view showing a construction of a development station of a conventional wet type image forming apparatus.

FIG. 7 shows a second form of the second pressing out rollers 5 and the second wiper blades 7. Referring to FIG. 7, each of a pair of second pressing out rollers 5 has two grooves 21 formed at each of the opposite end portions thereof, and a pair of concave-convex portions 23 having a shape corresponding to the corresponding second wiper blade 7 are formed on each of a pair of second wiper blades 7. Where the second pressing out rollers 5 and the second wiper blades 7 are formed in such a manner as just described, even where the amount of remaining development is large, it can be removed completely from the photosensitive member B.

It is to be noted that, while each of the grooves 21 formed on the second pressing out rollers 5 shown in FIGS. 1 and 7 has a channel-shaped cross section, it may otherwise have a V-shaped, trapezoidal or arcuate cross section or a cross section of some other suitable shape.

While a preferred embodiment of the present invention has been described using specific terms, such description is for illustrative purposes only, and it is to be understood that changes and variations may be made without departing from the spirit or scope of the following claims.

What is claimed is:

1. A belt type photosensitive member cleaning apparatus for a wet type image forming apparatus, comprising:

a first pressing out roller for being pressed against a belt type photosensitive member fed thereto to remove remaining liquid developer on said belt type photosensitive member;

a pair of second pressing out rollers for being pressed against said belt type photosensitive member on the downstream said of and adjacent to the opposite ends of said first pressing out roller to remove liquid developer having passed the opposite ends of said first pressing out roller and remaining on said belt-shaped photosensitive member, said pair of second pressing out rollers being arranged such that their outer ends are positioned outside a longitudinal range of said first pressing out roller, each of said pair of second pressing out rollers having an annular groove formed like a ring at each of opposite end portions on an outer periphery thereof; and a pair of wiper blades having a length greater than the longitudinal ranges of each of said pair of second pressing out rollers and disposed for being pressed against the outer peripheries of each of said pair of second pressing out rollers including inner faces of the annular grooves at, the opposite ends on the outer peripheries of each of said pair of second pressing out rollers.

2. A belt type photosensitive member cleaning apparatus for a wet type image forming apparatus as claimed in claim 1, wherein each of said pair of second pressing out rollers has a plurality of annular grooves formed at each of the opposite end portions thereof.

3. A belt type photosensitive member cleaning apparatus for a wet type image forming apparatus as claimed in claim 1, wherein each of said wiper blades has a concave-convex portion which is pressed against a respective one of said second pressing out rollers over the overall longitudinal range of each of the pair of second pressing out rollers including the annular grooves formed thereon.

* * * * *